United States Patent [19]

Ringers et al.

[11] 4,049,686

[45] Sept. 20, 1977

[54] DEGUMMING PROCESS FOR TRIGLYCERIDE OILS

[75] Inventors: Hendrik Johan Ringers, Rotterdam; Jacobus Cornelis Segers, Nieuwerkerk, both of Netherlands

[73] Assignee: Lever Brothers Company, New York, N.Y.

[21] Appl. No.: 665,526

[22] Filed: Mar. 10, 1976

[30] Foreign Application Priority Data

Mar. 10, 1975 United Kingdom ..... 9862/75

[51] Int. Cl.[2] ..... C11B 3/04

[52] U.S. Cl. ..... 260/424; 260/420

[58] Field of Search ..... 260/424, 420

[56] References Cited

U.S. PATENT DOCUMENTS

| | | | |
|---|---|---|---|
| 2,269,243 | 1/1942 | Baxter et al. | 260/424 |
| 2,296,850 | 9/1942 | Harrison | 260/424 X |
| 2,410,926 | 11/1946 | Bush et al. | 260/424 |
| 2,678,326 | 5/1954 | Ziels | 260/424 |
| 2,881,195 | 4/1959 | Hayes et al. | 260/424 |
| 3,590,059 | 6/1971 | Velan | 260/424 X |

*Primary Examiner*—Winston A. Douglas
*Assistant Examiner*—John F. Niebling
*Attorney, Agent, or Firm*—Melvin H. Kurtz

[57] ABSTRACT

Triglyceride oils are degummed according to a two-stage process, in which in the first step a substantially concentrated solution of an acid or an anhydride, having a pH of at least 0.5 as measured at 20° C in a one molar aqueous solution, is dispersed in the oil, and in a second step 0.2 to 5 wt.% of water is dispersed in the mixture obtained and an aqueous sludge is separated from the oil after the water has been in contact with the oil-acid-mixture for at least 5 minutes at a temperature below 40° C.

16 Claims, 1 Drawing Figure

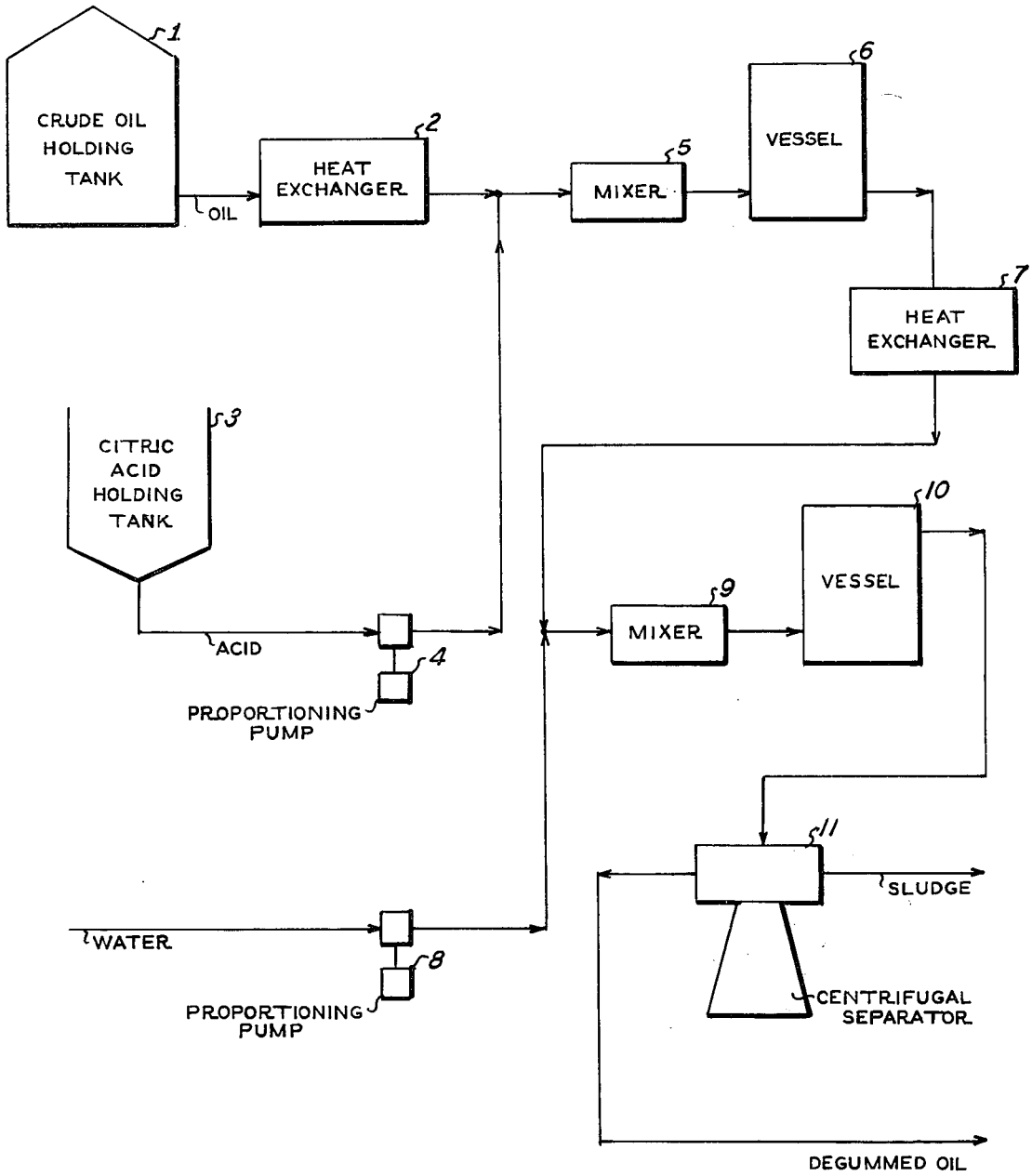
1
CRUDE OIL HOLDING TANK
OIL
2
HEAT EXCHANGER
5
MIXER
6
VESSEL
7
HEAT EXCHANGER
3
CITRIC ACID HOLDING TANK
ACID
4
PROPORTIONING PUMP
9
MIXER
10
VESSEL
11
SLUDGE
WATER
8
PROPORTIONING PUMP
CENTRIFUGAL SEPARATOR
DEGUMMED OIL

DEGUMMING PROCESS FOR TRIGLYCERIDE OILS

The invention relates to a process for refining triglyceride oils.

Triglyceride oils are a very valuable raw material. They consist mainly of triglycerides of fatty acids but usually contain some minor components, for instance colouring materials, sugars, waxes, partial glycerides, free fatty acids and phosphatides. Some, depending on the proposed use of the oil, of these minor components have to be removed as far as possible. This refining of the oil is an expensive procedure consisting of a number of stages. Because of the economic importance of refining, a large amount of work has been done both to improve and to simplify refining processes.

A particularly important group of the minor components is formed by the phosphatides. The phosphatides can be distinguished in two classes viz. the hydratable and the non-hydratable phosphatides. These constituents of the oil are also often referred to as gums. The removal of the non-hydratable phosphatides has always been and still is a great problem.

In the usual process as it is mostly practised to-day, the crude oil is first treated with water to hydrate the hydratable phosphatides, which subsequently can be removed for instance by centrifugal separation. The separated phosphatide mixture is usually called "lecithin" and finds many useful applications. To the predeslimed oil which usually still contains about 0.5% of non-hydratable phosphatides is added phosphoric acid, which serves to convert the non-hydratable phosphatides into hydratable ones, by releasing the calcium and magnesium ions bound to them. Subsequently an aqueous alkali hydroxide solution is added to remove the phosphatides and to neutralize the free fatty acids. Thereafter the soapstock so formed is separated from the neutralized oil by centrifugal separation. Subsequently the oil is usually bleached with a bleaching earth and deodorized by steaming.

The above-described process has many disadvantages. In the first place in the neutralization step an extra amount of alkali is needed to neutralize the phosphoric acid which was previously added. Secondly the calcium and magnesium ions, released from the non-hydratable phosphatides form insoluble phosphate compounds. The precipitated calcium and magnesium phosphates form a heavy sludge containing entrained oil, which sludge fouls the centrifugal bowls of the centrifuges used to separate the soapstock from the oil. Therefore, the centrifuges have to be cleaned at least once a day, which leads to production losses and makes the process very laborious. Of course, oil losses too are increased due to entrainment with the sludge. Thirdly, the phosphatides, sugars, glycerol and other minor components removed get into the soapstock, which causes difficulties in the soap-splitting process. In the soap-splitting process sulphuric acid is added to the soapstock, causing separation of the free fatty acids and a water phase. The latter contains the sodium sulphate resulting from the soap-splitting process but also polar phosphatides, sugars, glycerol and some of the other minor components. This heavily contaminated aqueous phase is usually discharged into the drain, causing a pollution of surface waters or, if this is forbidden by law, requiring costly purification equipment.

Many attempts have been made to overcome all these disadvantages. However, none of the proposed processes has, until now, resulted in a practical economical process. Such proposed processes include for instance degumming or desliming of the oil by treatment with strong mineral acids, such as hydrochloric acid, nitric acid etc, followed by washing with water. However, strong mineral acids have a deleterious effect on the treated oils, and cannot be used with edible oils. Moreover, the usual technical apparatus, like centrifuges, are severely corroded by such acids. Further it has been proposed to use edible organic acids, organic acid anhydrides, polybasic acids, detergent solutions, salt solutions etc., both in diluted and in concentrated form for the degumming of oils, which proposals were either not practically feasible or gave an insufficient degumming. Especially, the removal of the non-hydratable phosphatides presented serious difficulties.

U.S. Pat. No. 2,782,216, for instance, describes the use of an acid anhydride in a process for preparing break-free oils. The anhydride and water can be added in any order or together, and the whole process should be carried out at a temperature in the range of 40° to 100° C.

Further it is stated that the use of acids was never successful in degumming edible oils.

In French patent specification 1,385,670 a two-stage process for degumming oils has been described, in which first concentrated hydrochloric acid is added to the oil while the oil preferably has a temperature of 10° to 50° C and in a next step water is added. After a suitable residence time at a temperature of 18° to 30° C the mixture is centrifuged. Though the degumming effect is good, this process cannot be used on a technical scale because of the corroding effect of hydrochloric acid on normal equipment. Moreover, the oils and the lecithin are chemically attacked by the hydrochloric acid, which makes its use for edible oils not recommendable.

It has now been discovered that the phosphatides and other minor components can be advantageously removed from crude or water-deslimed triglyceride oils which are substantially liquid at 40° C, by dispersing an effective amount of a substantially concentrated acid or anhydride, having a pH of at least 0.5 as measured at 20° C in a one molar aqueous solution, in the oil, subsequently dispersing 0.2 to 5% by weight of water in the mixture obtained, and finally separating an aqueous sludge containing the gums from the oil, the mixture of oil, water and acid being maintained for at least 5 minutes at a temperature below 40° C before separating the aqueous sludge.

It is believed that the concentrated acid or anhydride converts the non-hydratable phosphatides into hydratable forms. After adding water and at a temperature below about 40° C, the phosphatides are presumably converted into a semi-crystalline phase, which also contains the acid or anhydride and the water added before, most of the sugar-like compounds, glycerol and waxes present and also the magnesium and calcium ions, previously bound to the non-hydratable phosphatides. After separation, preferably by centrifuging, the phosphatides, together with the other components contained therein, form an aqueous sludge which does not stick to the metal of the separation apparatus, e.g. the centrifugal bowls, which makes the separation an easy process step, and wherein cleaning of this apparatus is seldom necessary, in sharp contrast to the conventional process.

A further advantage of the process of the invention resides in the fact that the acid or anhydride used is separated from the oil with the phosphatides. Therefore the use of an extra amount of lye in the neutralization of the oil is avoided. Moreover, the soapstock obtained after the neutralization step contains a strongly reduced amount of phosphatides; hence the effluent of the soapstock-splitting process contains much less organic material than in the conventional refining proces, thereby diminishing waste-water problems.

A further surprising phenomenon has been discovered in the treatment of crude oils, containing also the hydratable phosphatides. It has proved possible to use a far smaller amount of acid or anhydride than in the treatment of predeslimed oils. This phenomenom suggests that in this case it is not necessary to convert all the non-hydratable phosphatides, which are still removed. The good separation which is nevertheless obtained might be attributable to a kind of agglomeration of the micelles, the surfaces of which being modified by the acid treatment. However, it is to be understood that such theoretical explanations should not be construed to limit the invention in any way.

It will be clear that the thorough removal of the phosphatides, waxes, as well as sugar-like components, magnesium, calcium and other minor components, made possible by the process of the invention, leads to considerable simplifications in the subsequent refining processes, viz. neutralization, bleaching and deodorization. One or more of these refining steps might even be omitted altogether.

With the process of the invention all triglyceride oils may be treated, e.g. soybean oil, rapeseed oil, sesame seed oil, sunflower seed oil, rice bran oil, grapeseed oil, coconut oil, cottonseed oil, groundnut oil, linseed oil, maize (corn) oil, palm oil, palm kernel oil, safflower oil, sal fat, shea fat, etc.

As the acid in principle all inorganic and organic acids, having a pH of at least 0.5 as measured at 20° C in a one molar aqueoussolution, may be used, e.g. phosphoric acid, acetic acid, citric acid, tartaric acid, succinic acid, etc., or mixtures of such acids. The use of aggressive, corrosive and/or toxic acids is preferably avoided. It is most preferred to use edible acids, such as acetic acid, citric acid, tartaric acid, lactic acid, etc., for in that case the acid sludge can be used as animal feedstuff, and in the refining of crude oils the separated lecithin may be used, for instance, to prepare emulsifiers for the food industry. Citric acid is the most preferred acid.

Surprisingly enough the amount of acid or anhydride to be added hardly depends on the amount of phosphatides in the oil. For instance, in the desliming of predeslimed soybean oil containing about 0.5 wt.% phosphatides, an amount of 0.3 wt.% of a 50% citric acid solution gives an excellent desliming effect. However, in the desliming of crude soybean oil containing about 2.5wt.% phosphatides the same and far lesser amounts of acid give an equally good desliming.

The acid is preferably added in concentrated form. For citric acid usually a saturated or nearly saturated solution is added, which amount to an about 50 wt.% solution. Of course, less concentrated solutions can be used and good results have been obtained by using a concentration between about 10 and about 50 wt.%, more preferably 30 to 50 wt.%.

The acid is preferably added to the oil while the oil has a temperature above about 60° C. Temperatures up to 100° C and higher can be used and preferably the temperature is 70° to 80° C; higher temperatures than these do not give further improvements. Temperatures between 20° C and60° C may also be used; however, the time required for homogeneously mixing the acid with the oil at such lower temperatures might be longer, but usually the same degree of degumming is obtained.

After the acid has been added to and thoroughly mixed with the oil, the acid is given some time to react with the phosphatides. Usually a contact time of the oil with the acid of about 1 to 20 minutes is sufficient, though longer and shorter contact times can also be used. The time required for mixing the acid or anhydride with the oil is usually sufficient to ensure a sufficient reaction time.

If the acid was added at a high temperature the oil is preferably next cooled to a temperature below 40° C, preferably to 25° C to 35° C, for instance by passage through a heat exchanger. Temperatures down to 0° C can be used as long as the oil remains liquid.

Preferably after cooling the oil-acid mixture to below 40° C, a small amount of water is added, preferably distilled or demineralized water. However, the presence of electrolytes, surfactants, proteins does not influence the desliming, and such compounds are separated with the aqueous sludge. Alternatively, the water can also be added while the oil still has a high temperature. The amount of water is preferably just sufficient to hydrate substantially all of the phosphatides present. A slight excess is not harmful; however, care should be taken not to add too much water, for then a third phase can be formed, which may lead to difficulties in the subsequent centrifugal separation of the acid sludge. Very low amounts of water can be used. However, it might be difficult to disperse such small amounts homogeneously in the oil. The amount of water added is usually about 0.2 to 5 wt.%, preferably about 0.5 to about 3 wt.%, and more preferably about 1 to about 2 wt.%, calculated on the oil.

After the water has been added to the oil and thoroughly mixed with it, the water is left in contact with the oil with mild agitation, for a period ranging from 5 minutes to several hours. The longer times are needed with pre-deslimed oils. For pre-deslimed oils the contact time is preferably 0.5 to 2 hours and more preferably 1 to 2 hours. Surprisingly enough for crude oils a contact time of only 5 to 20 minutes already gives a good desliming effect, even when only a small amount of acid was used. Longer contact-times usually do not give any appreciable further improvement, but are not harmful. So contact-times of several days are possible. To obtain a good desliming it is essential that during said contact time the oil/water/acid mixture has a temperature below about 40° C, preferably 25° C to 35° C.

Finally an aqueous sludge containing the phosphatides is separated from the oil, preferably by centrifugation. This separation is mostly carried out at a temperature below about 40° C, preferably 25° to 35° C.

Above 40° C, especially above 50° C, the phosphatides transform to a mesomorphic lamellar phase, which is more difficult to separate from the oil. However, it has proved possible to facilitate the separation by heating the mixture to a temperture in the range of 60° to 90° C and immediately centrifuging the mixture, provided the heating step is carried out in a sufficiently short time to avoid conversion of the phosphatides to their high temperature phase. Preferably the heating is carried out in no more than 5 minutes, were preferably in no more than 1 minute. Such fast heating rates can easily be achieved with the aid of a conventional heat exchanger.

The separated phosphatides also contain most of the sugar-like compounds, glycerol, the magnesium and calcium ions and other minor components originally present in the oil, together with the acid or anhydride added. The acid in the sludge acts as a preservative, which therefore is not subject to biodetoriation. In case an edible acid, like citric acid was used in the first step of the process, the acid sludge can be added to animal foodstuffs and improve the nutritive value thereof.

The oil can be further treated according to processes known in the art of oil refining e.g. neutralizing, bleaching and deodorization. In these process steps the last traces of phosphorus compounds which were not removed in the desliming process, are removed. Due to the very low content of phosphatides and other minor components in the oil after its desliming according to the process of the invention important advantages are made possible in the subsequent refining steps, such as: use of less alkali in the neutralization, a cleaner soapstock resulting in improved acid oils, less and cleaner effluent after the soapstock-splitting process; use of less bleaching earth in the bleaching step, no discolouring of the oil in the deodorization step, etc. Furthermore, the degummed oils can be stored for longer periods without degradation and without forming deposits in the tanks.

After the degumming, the oil may be washed with water, however, this is usually not necessary.

The process of the invention may be carried out as a batch process but is preferably carried out in a continuous manner.

In the accompanying drawing a schematic lay-out of an apparatus for carrying the preferred mode of the process of the invention is given. Oil from a holding tank 1 is led through a heat-exchanger 2, wherein it is heated to a temperature of 70° C. A 1:1 citric acid solution from holding tank 3 is added to the heated oil via a proportioning pump 4. The citric acid solution is thoroughly mixed with the oil in a mixer 5, for instance a centrifugal mixer. The mixture of oil and citric acid is led into vessel 6, wherein it is allowed a residence time of about 10 minutes while being stirred. After leaving this vessel the mixture flows through a heat-exchanger 7, wherein it is cooled to a temperature of 20° to 25° C, whereafter distilled water is added via proportioning pump 8. In mixer 9 the water is thoroughly mixed with the oil/citric acid mixture and then the mixture flows into vessel 10, wherein it is allowed a residence time of about 1 hour while being mildly stirred.

Finally the mixture is separated into deslimed oil and an acid sludge in the centrifugal separator 11.

EXAMPLES I - III

To a soybean oil, which had been pre-degummed by washing with water at a temperature of 70° C, was added 0.3 wt.% of a 50% citric acid solution while the oil had a temperature of 70° C. After a contact time of about 20 minutes the oil was cooled to 20° -25° C, mixed with water, kept for 1 hour in a holding tank and then centrifuged off.

In Example I the oil was additionally washed with water and centrifuged again. This washing step was omitted in Examples II and III. The degummed oil was heated to about 85° C, neutralized with 1 to 2N lye and washed and dried. The particulars of each example and the results are summarized in table 1.

TABLE 1

| Example | Amount of water (wt % on oil) | Amount of water for washing step after degumming (wt% of oil) | Phosphorus content (ppm) Starting oil | Deslimed oil | Deslimed and washed oil | Neutralized oil | Neutralized and washed oil |
|---|---|---|---|---|---|---|---|
| I | 2 | 5 | 125 | 31 | 22 | 4 | 3 |
| II | 2 | none | 128 | 28 | — | 4 | 2 |
| III | 1 | none | 118 | 29 | — | 4 | 1 |

It can be seen that the additional washing step of example I did not give any improvement.

The phosphorus content of the starting oils varies somewhat, and this applies to all of the examples, especially those wherein the treatment of extracted soybean oil is described. As is generally known, the P-content varies according to origin, quality and even storage time of the oil.

When the above examples are repeated using acetic acid, tartaric acid, lactic acid, phosphorus acid, acetic anhydridge or propionic anhydride, substantially the same results are obtained.

EXAMPLES IV - VI

In these examples, which were carried out for a whole week on a technical scale, the amount of citric acid and the contact-times of oil with citric acid and of oil with water were varied. The citric acid was added to predegummed soybean oil, while the latter had a temperature of 70° C. After a contact time as indicated in Table 2, the oil was cooled to 20° C to 25° C and mixed with water. After a contact-time with water as indicated in Table 2 the oil was centrifuged off. Then the oil was neutralized at 85° C with 2N or 4N lye (20% excess) and washed and dried. The circumstances of each example and the results obtained are summarized in Table 2. During the week the trials took, the centrifuge bowls did not need to be cleaned.

TABLE 2

Result of three long duration (one week) degumming runs

| Example | | IV | V | VI |
|---|---|---|---|---|
| citric acid solution (1:1) | wt.% on oil | 0.3 | 0.15 | 0.3 |
| water | wt.% on oil | 1.0 | 0.5 | 1.0 |
| contact time citric acid/oil | min. | 20 | 10 | 10 |
| contact time water/oil | min. | 60 | 30 | 60 |
| P-content of starting oil | ppm | 124 | 99 | 99 |
| P-content of degummed oil | ppm | 22 | 54 | 51 |
| P-content of neutralized oil | ppm | 3 | 12 | 9 |
| P-content of neutralized, washed oil | ppm | 0 | 16 | 3 |

The soapstocks from the neutralization step and the washing water of the subsequent washing step of Example VI were combined and splitted with sulphuric acid. The acid water obtained was analysed and compared with the acid water from a conventional centrifuge-refining-process. The results of the analysis are summarized in Table 3.

TABLE 3

| | composition of acid water of example VI | Acid water from standard centrifuge line |
|---|---|---|
| Amount of acid water (wt% on oil | 17 | 30 |
| TFM in petroleum ether in ppm | 450 | 60* |
| COD in ppm | 5,000 | >15,000 |
| Glycerol ppm | 570 | 10,330 |
| P in ppm | 150 | —** |
| N in ppm | 23 | —** |
| $SO_4^{=}$ | 1.14 | —** |

*TFM in ether was 1050 ppm; this shows that a great part of the fatty matter was oxized and hence insoluble in petroleum ether.
**Not measured.

This table shows that the COD (chemical oxygen demand) and the glycerol content of soapstock from soybean oil degummed according to the process of the invention were lower than the values in acid water from the normal refining procedure. Moreover, the amount of effluent is reduced by more than 50% if the lecithin from the first step is kept apart.

EXAMPLES VII - XII

In these examples the influence on the degumming of differences in cooling temperature and amount of water added in the degumming step were investigated.

In all experiments 0.3 wt.% citric acid solution 1:1 was added to pre-degummed soybean oil at a temperature of 70° C. After 10 min. the oil was cooled to the temperature mentioned in the table and the specified amount of water was added. After 1 hr. the oil was centrifuged. The results of these experiments are summarized in Table 4.

TABLE 4

| Example | Cooling temperature (° C) | Amount of water added (wt. %) | P in starting oil (ppm) | P in degummed oil (ppm) |
|---|---|---|---|---|
| VII | 25 | 1 | 103 | 49 |
| VIII | 25 | 0.5 | 102 | 58 |
| IX | 30 | 1 | 101 | 36 |
| X | 30 | 0.5 | 102 | 54 |
| XI | 35 | 1 | 96 | 40 |
| XII | 35 | 0.5 | 106 | 45 |

Example IX, wherein 1 wt.% water was added when the oil had a temperature of 30° C, gave the best result.

EXAMPLES XIII - XX

To crude extracted soybean oil (obtained by extraction of soybeans with hexane) containing 537 ppm P, 0.3 wt.% of a 1:1 citric acid solution was added at a temperature of 70° C. After 15 min. the oil was cooled to 20° C, which took 30 min. After cooling the oil was allowed to stand for 45 min. or 2 hr. 45 min; thereafter 1.5 or 2.5 wt.% water was added to the oil. After a contact time of 15 min. or 1 hr. the oil was centrifuged off and the phosphorus content was determined. The results are summarized in Table 5.

TABLE 5

| Example | Residence time after cooling (h) | Amount of water added (wt% on oil) | Contact time water with oil (h) | P content of degummed oil (ppm) |
|---|---|---|---|---|
| XIII | ¾ | 1½ | ¼ | 23 |
| XIV | 2¾ | 1½ | ¼ | 19 |
| XV | ¾ | 2½ | ¼ | 18 |
| XVI | 2¾ | 2½ | ¼ | 20 |
| XVII | ¾ | 1½ | 1 | 11 |
| XVIII | 2¾ | 1½ | 1 | 12 |
| XIX | ¾ | 2½ | 1 | 10 |

TABLE 5-continued

| Example | Residence time after cooling (h) | Amount of water added (wt% on oil) | Contact time water with oil (h) | P content of degummed oil (ppm) |
|---|---|---|---|---|
| XX | 2¾ | 2½ | 1 | 13 |

From the table it is clear that the residence time after cooling has no influence on the desliming. The best degumming is obtained when the contact time of water with oil is about 1 hour. The amount of water added does not have any influence either. The phosphorus content of the degummed oil is remarkably low in all the examples, which proves the beneficial results obtainable with the process of the invention. The lecithin obtained contained about 5% citric acid.

EXAMPLES XXI - XXVIII

To investigate the possibility of using lower amounts of citric acid, trails were carried out wherein very low amounts of citric acid were used. The tests were carried out on a pilot plant scale with a throughput of 50 kg oil/hour. To extracted soybean oil a 1:1 citric acid solution was added in various amounts while the oil had a temperature of 70° C. After 15 min. the oil was cooled to 23° C, which took about 30 min. After 2 hours water was added and after a contact time of water with oil of 15 min. to 75 min. the oil was centrifuged off. Then the oil was washed with water. The results of these experiments are summarized in Table 6.

TABLE 6

| Example | Amount of citric acid solution (wt. %) | Amount of water (wt. %) | P-content (ppm) starting oil | after degumming | after water washing |
|---|---|---|---|---|---|
| XXI | 0.003 | 5 | 926 | 148 | 122 |
| XXII | 0.05 | 5 | 882 | 89 | 76 |
| XXIII | 0.10 | 5 | 877 | 54 | 41 |
| XXIV | 0.15 | 5 | 672 | 9 | 5 |
| XXV | 0.03 | 1.5 | 716 | 18 | 7 |
| XXVI | 0.05 | 1.5 | 763 | 18 | 6 |
| XXVII | 0.10 | 1.5 | 700 | 17 | 5 |
| XXVIII | 0.15 | 1.5 | 703 | 37* | 2 |

*Centrifuge was temporarily not properly adjusted.

When 5 wt.% water is used for the degumming the amount of phosphatides removed is strongly dependent on the amount of citric acid added; however, when 1.5 wt.% is used even a low amount of 0.03 wt.% of 1:1 citric acid solution gives an excellent degumming.

EXAMPLES XXIX - XXXIV

To investigate further the effect of the contact-time of water with oil when using low amounts of citric acid solution in the degumming of extracted soybean oil, the following experiments were carried out: To extracted soybean oil with a phosphorus content of 700 ppm various amounts of a 1:1 citric acid solution were added at a temperature of 70° C. After 15 min. the oil was cooled to 23° C, which took about 30 min. Immediately after cooling 1.5 wt.% water was added and after varying contact-times of water with oil, the oil was centrifuged. The results are summarized in Table 7.

TABLE 7

| Example | Amount of citric acid solution 1:1 (wt. %) | Contact time water with oil (hr) | Analytical data P (ppm) | CA (ppm) | Mg (ppm) |
|---|---|---|---|---|---|
| XXIX | 0.003 | 2 | 42 | 18 | 11 |
| XXX | 0.003 | 1¼ | 46 | 16 | 9 |

TABLE 7-continued

| Example | Amount of citric acid solution 1:1 (wt. %) | Contact time water with oil (hr) | Analytical data P (ppm) | CA (ppm) | Mg (ppm) |
|---|---|---|---|---|---|
| XXXI | 0.003 | ½ | 41 | — | — |
| XXXII | 0.01 | 2 | 12 | 3.9 | 2.1 |
| XXXIII | 0.01 | 1¼ | 21 | 6.8 | 3.8 |
| XXXIV | 0.01 | ½ | 31 | — | — |

It can be seen that by using 0.003 wt.% of the citric acid solution the contact time of water with oil does not have any influence on the phosphatide removal; however, when 0.01 wt.% of the citric acid solution is used the best results are obtained at a contact-time of 2 hours. Also the calcium and magnesium contents of the degummed oil were determined. It can be seen that the calcium- and magnesium-ions are removed together with the phosphatides.

COMPARATIVE EXAMPLE

To 50 g soybean oil was added 2% water or 2% of a 5% citric acid solution at temperatures of 20° C or 70° C and mixed with a vibrator for 5 minutes. Thereafter the oil was centrifuged at 3000 ppm at the same temperature for 15 min. and finally the oil was filtered over filter paper. The results of the degumming trials are summarized in Table 8.

TABLE 8

| Trial number | De gumming method | Phosphorus content I | II | III | IV | V | VI | VII |
|---|---|---|---|---|---|---|---|---|
| | Starting oil | 968 | 882 | 646 | 645 | 910 | 999 | 758 |
| a | 2% water, 20° C | 163 | 156 | 131 | 53 | 119 | 144 | 85 |
| b | 2% water, 70° C | 203 | 173 | 141 | 65 | 133 | 140 | 113 |
| c | 2% citric acid acid (5%), 20° C | 165 | 136 | 115 | 62 | 133 | 163 | 80 |
| d | 2% citric acid (5%), 70° C | 198 | 138 | 135 | 14 | 47 | 45 | 100 |

From Table 8 it is clear that when water alone or diluted citric acid are used in one step the degumming effect obtained varies greatly and is highly dependent on the quality of the used oil.

EXAMPLES XXXV - XXXVII

The oils used in the above comparative example were also treated according to the process of the invention. At 80° C or 90° C 0.1 wt.% citric acid solution with concentrations of 50 wt.% and 25 wt.% respectively were added to the oil. The oil was agitated with a vibrator for 5 min, cooled to 20° C, and after addition of 1.0 wt.% water again agitated for 5 min. and allowed to stand for 15 min. while occasionally being stirred. Then the oil was centrifuged at 3.000 rpm for 15 min. and filtered over filter paper. The results are summarized in Table 9.

TABLE 9

| Example | Temperature citric acid addition(° C) | Concentration citric acid solution (wt. %) | Rest-P-content (ppm) in degummed oil I | II | III | IV | V | VI | VII |
|---|---|---|---|---|---|---|---|---|---|
| XXV | 80 | 50 | 31 | 24 | 41 | 9 | 10 | 15 | 30 |
| XXXVI | 80 | 25 | 54 | 31 | 69 | 6 | — | 34 | 37 |
| XXXVII | 90 | 25 | 58 | 30 | 50 | — | — | — | — |

"—" means: not determined.

From Table 9 it is clear that the process of the invention gives low rest phosphorus contents with all starting oils.

EXAMPLE XXXVIII

To 700 g grapeseed oil was added 0.3 wt.% of a 1:1 citric acid solution, while the oil had a temperature of 20° C, whereafter the oil was stirred with a mechanical stirrer at 600 rpm for 15 min. The 5 wt.% water was added to the oil and the stirring was continued for another 15 min. Finally the oil was centrifuged off and dried. The results are summarized in Table 10.

TABLE 10

| | P (ppm) | waxes (ppm) |
|---|---|---|
| Starting oil | 24 | 8170 |
| degummed oil | 8 | 175 |

This example shows that the degumming process of the invention also removes the greater part of the waxes from oils rich in waxes. This fact leads to considerable savings in the final conventional dewaxing step.

EXAMPLES XXXIX - XLI 700 g sunflowerseed oil were heated to 70° C and 0.3 wt.% of a 1:1 citric acid solution was added to the oil and the oil was stirred with a mechanical stirrer at 600 rpm. The oil was cooled to 20° C, whereafter 5 wt.% water was added to the oil and the stirring was continued for 1 hour. Then the oil was centrifuged off, neutralized and bleached with 1% of an active clay (Tonsil). Finally the oil was dewaxed by cooling it to 15° C and slowly stirring at that temperature for 4 hours, adding 1% of a filter aid and filtering off. The results are summarized in Table 11.

TABLE 11

| Example | Analytical data of Starting oil P (ppm) | Wax (ppm) | Degummed oil P (ppm) | Wax (ppm) | Neutralized, bleached and dewaxed oil P (ppm) | cooling test* |
|---|---|---|---|---|---|---|
| XXXIX | 120 | 320 | 19 | 38 | — | clear |
| XL | 128 | 490 | 11 | 110 | 8 | clear |
| XLI | 84 | 80 | 27 | 60 | 2 | clear |

*3 h. at 0° C.

These examples, too, show that the degumming process of the invention also removes the greater part of the waxes from oils containing them.

EXAMPLES XLII and XLIII

To so-called tank bottoms of sunflower oil 0.3 wt.% of a 50% citric acid solution was added while the oils had a temperature of 20° -25° C. The mixture was agitated for 30 minutes. Thereafter 5% of an aqueous solution containing 0.4% sodium laurylsulphate and 2% magnesiumsulphate was added and the mixture agitated for 1 hour, whereafter the mixture was allowed to rest for 12 hours. Then the aqueous phase was allowed to run off. The results are given in the table 12.

TABLE 12

| | Analytical data of | | | |
|---|---|---|---|---|
| | Starting oil | | degummed oil | |
| Example | P (ppm) | Wax (ppm) | P (ppm) | Wax (ppm) |
| XLII | 143 | 700 | trace | 73 |
| XLIII | 894 | 36,400 | 14 | 730 |

EXAMPLES XLIV - LI 500 g of sunflower oil were mixed with 0.15% of a 50% citric acid solution while the oil had a temperature of 70° C or 20° C. The mixture was stirred for 15 minutes and then brought at 30° C in the cases where the initial temperature was 70° C. Then 5 wt.% of water was added, followed by 1 hour stirring and centrifuging. The results are summarized in table 13.

TABLE 13

| | | | p-content | |
|---|---|---|---|---|
| Example | Temperature range (° C) | Amount of citric acid solution (1:1) (wt. %) | crude oil | degummed oil |
| XLIV | 70 → 30 | 0.30 | 97 | 10 |
| XLV | 70 → 30 | 0.15 | 97 | 15 |
| XLVI | 20 → 20 | 0.30 | 97 | 58 |
| XLVII | 20 → 20 | 0.15 | 97 | 55 |
| XLVIII | 70 → 30 | 0.30 | 150 | 17 |
| XLIX | 70 → 30 | 0.15 | 150 | 8 |
| L | 20 → 20 | 0.30 | 150 | 26 |
| LI | 20 → 20 | 0.15 | 150 | 31 |

EXAMPLES LII - LV

Examples XLIV - LI were repeated, however while using a rapeseed oil containing 131 ppm of P instead of sunflower oil. The results are summarized in table 14.

TABLE 14

| Example | Temperature-range (° C) | Amount of citric acid solution (1:1) (wt. %) | P-content of[1)] degummed oil (ppm) |
|---|---|---|---|
| LII | 70 → 30 | 0.3 | 23 |
| LIII | 70 → 30 | 0.15 | 46 |
| LIV | 30 → 30 | 0.3 | 36 |
| LV | 30 → 30 | 0.15 | 58 |

[1)]The average of two experiments.

EXAMPLES LVI - LIX

Examples XLIV-LI were repeated, however, using linseed oil containing 160 ppm P instead of sunflower oil. The results are summarized in Table 15.

TABLE 15

| Example | Temperature-range (° C) | Amount of citric acid solution (1:1) (wt. %) | P-content of degummed oil (ppm)[1)] |
|---|---|---|---|
| LVI | 70 → 30 | 0.3 | 27 |
| LVII | 70 → 30 | 0.15 | 17 |
| LVIII | 30 → 30 | 0.3 | 27 |
| LIX | 30 → 30 | 0.15 | 20 |

EXAMPLES LX - LXI

To investigate the influence of the course of the temperature during the degumming process, the following experiments were carried out: To 500 g of crude extracted soybean oil was added 0.07 wt.% of a 50% citric acid solution while the oil had a temperature of 70° C. After 15 minutes of stirring 2.5 wt.% $H_2O$ was added, followed by 2 hours' stabilisation. At last the hydrated phosphatides were centrifuged off at the temperature specified in Table 16. The course of the temperatures has been given in the same table. The increase of the temperature before centrifuging in the comparative Examples 2 and 3 took about 30 min. which clearly is too long. The phosphatides have been converted to their high temperature phase and removal of the phosphatides is bad. Crude oil A had a P-content of 768 ppm and crude oil B 804 ppm.

TABLE 16

| | | P-content of degummed | |
|---|---|---|---|
| Example | Course of the temperature | oil A | oil B |
| Comparative | whole process at 70° C centrifuging at 70° C | 75 | 90 |
| LX | temperature decreased from 70° C to 30° C after addition of citric acid, centrifuging at 30° C | 18 | 19 |
| Comparative 2 | temperature decreased from 70° C to 30° C after addition of citric acid, centrifuging at 70° C | 58 | 70 |
| LXI | temperature decreased from 70° C to 30° C after addition of water, centrifuging at 30° C | 22 | 20 |
| Comparative 3 | temperature decreased from 70° C after addition of water centrifugation at 70° C | 55 | 52 |

EXAMPLES LXII - LXVII

In a continuous degumming process a 40 wt.% citric acid solution was added to the oil, while the oil had a temperature of 70° C. After cooling to 25° -28° C 2.5 wt.% of water was added and the mixture was led through a holding tank with a mean residence time of about 1 hour still at 25° -28° C. Next the mixture was heated to 50° -65° C in a heat-exchanger, which heating step took less than 1 minute, and immediately centrifuged. The results are summarized in table 17.

TABLE 17

| Example | P-content of crude oil (ppm) | citric acid conc. in the oil (wt. %) | P-content of degummed oil |
|---|---|---|---|
| LXII | 732 | 0.014 | 21 |
| LXIII | 732 | 0.021 | 19 |
| LXIV | 723 | 0.028 | 19 |
| LXV | 792 | 0.035 | 34 |
| LXVI | 784 | 0.049 | 17 |
| LXVII | 723 | 0.084 | 20 |

A further beneficial result of centrifuging at higher temperature was that the oil content of the sludge was only about 32% compared with 40–45% when the centrifuging was carried out at 25° -28° C.

EXAMPLES LXVIII - LXX

To show the influence of the temperature during the water-oil contact the following experiments were carried out: To a water-degummed soybean oil 0.3 wt.% of a 1:1 citric acid solution was added while the oil had a temperature of 70° C. After cooling to the temperature mentioned in table 18,5 wt.% of a solution containing 5 wt.% of $Na_2SO_4$ and 0.5 wt.% sodium laurylsulphate was added and the mixture allowed to rest for 2 hours. Thereafter the sludge was separated from the oil and the oil was washed and bleached in a usual manner. The results are summarized in the following table 18.

TABLE 18

| Example | temperature of water-oil contact | P-content (ppm) of crude oil | de-gummed oil | washed and bleached oil |
|---|---|---|---|---|
| LXVIII | 5 | 105 | 36 | 3 |
| LXIX | 20 | 101 | 14 | 1 |
| LXX | 35 | 126 | 22 | 2 |
| Comparison 4 | 50 | 158 | 86 | 38 |

EXAMPLE LXXI

In a continuous process 0.1% by volume of 85% $H_3PO_4$ was added to a crude rapeseed oil with a phosphorus content of 201 ppm. After cooling to 30° C 1.5% by weight of water was added and after 1 hour the mixture was centrifuged. After this treatment the oil had a phosphorus content of 62 ppm. After neutralizing with 4N NaOH the P-content of the oil was further decreased to 2 ppm.

EXAMPLE LXXII

To 500 g crude soybean oil with a P-content of 489 ppm was added 0.1% by weight of acetic anhydride (97.5%). After 15 minutes agitating with 600 rpm the mixture was cooled to 30° C. Next 2.5% by weight of water was added and after 2 hours, while agitating at 200 rpm, the mixture was centrifuged. The resulting oil had a P-content of 46 ppm (average of two experiments).

EXAMPLE LXXIII

To 500 g crude soybean oil with a P-content of 679 ppm was added 0.2% by weight of acetic acid (100%) while the oil had a temperature of 70° C. After stirring with 600 rpm for 15 minutes the oil was cooled to 30° C and 2.5% by weight of water was added. After 2 hours stirring with 200 rpm still at 30° C the mixture was centrifuged. The resulting oil had a P-content of only 35 ppm.

We claim:

1. A process for removing phosphatides from triglyceride oils which are substantially liquid at 40° C comprising the steps of dispersing an acid or acid anhydride in the oil, said acid or acid anhydride having a pH of from 0.5 to 7 as measured at 20° C in a one molar aqueous solution and said oil being at a temperature of from 20° to 100° C; adjusting the temperature of the mixture to the range of from the lowest temperature at which the oil remains a liquid to 40° C; dispersing from 0.2 to 5 percent by weight of water in the mixture; maintaining the temperature of the mixture of oil, acid and water from 5 minutes to several days; and, thereafter separating an aqueous sludge containing the phosphatides from the oil.

2. Process according to claim 1 in which the temperature of the oil is from 65° to 90° C when the acid or anhydride is added.

3. Process according to claim 1 in which an aqueous solution of an edible acid containing 10 to 50% of the acid of water is used.

4. Process according to claim 3, in which an aqueous citric acid solution is used.

5. Process according to claim 4, in which from 0.001 to 0.5% by weight of citric acid, calculated as dry acid, is added to the oil.

6. Process according to claim 5, in which 0.001 to 0.01% by weight of citric acid is added to a crude extracted oil.

7. Process according to claim 5, in which 0.1 to 0.3% by weight of citric acid is added to an oil, from which the hydratable phosphatides have been substantially removed.

8. Process according to claim 1, in which before separating the aqueous sludge, the oil, water and acid mixture is adjusted to 20° C - 35° C.

9. Process according to claim 1, in which 0.5 to 3% by weight of water is added to the oil.

10. Process according to claim 9, in which 1 to 2% by weight of water is added to the oil.

11. Process according to claim 8, in which before the separation of the aqueous sludge, the mixture of oil, water and acid is maintained for at least 0.5 hours.

12. Process according to claim 1, in which the aqueous sludge is separated from the oil by centrifuging.

13. Process according to claim 12, in which the mixture of oil, acid and water after the contact time is heated to a temperature of 60° C to 90° C in a sufficiently short time to avoid conversion of the gums to their high temperature phase and thereafter the mixture is immediately centrifuged.

14. Process according to claim 13, in which the heating is carried our in about from 1 second to about 1 minute.

15. Process according to claim 1, in which the process is carried out continuously.

16. Process according to claim 1, in which an oil chosen from the group consisting of soybean oil, rapeseed oil, sesame seed oil, sunflower seed oil, rice bran oil, grapeseed oil, coconut oil, cottonseed oil, groundnut oil, linseed oil, maize oil, palm oil, palm kernel oil, safflower oil, sal fat and shea fat is used.

* * * * *